United States Patent [19]

Iggulden et al.

[11] Patent Number: 5,013,895

[45] Date of Patent: May 7, 1991

[54] PERSONAL POSTNET BARCODE PRINTERS

[76] Inventors: Jerry R. Iggulden, 21600 Cleardale St., Santa Clarita, Calif. 91321; Donald A. Streck, 832 Country Dr., Ojai, Calif. 93023

[21] Appl. No.: 425,301

[22] Filed: Oct. 23, 1989

[51] Int. Cl.[5] ..... G06C 27/00

[52] U.S. Cl. ..... 235/110

[58] Field of Search ..... 235/101, 58 R, 58 P, 235/60 R, 608, 109, 110, 462; 107/93.25, 95

[56] References Cited

U.S. PATENT DOCUMENTS 3,504,622 4/1970 Morrison ..... 107/95 X 3,955,497 5/1976 Sydnor ..... 104/93.25

*Primary Examiner*—Brian W. Brown

*Attorney, Agent, or Firm*—Donald A. Streck

[57] ABSTRACT

This invention provides a low-cost printer for use by businesses and individuals to print a ten digit Postnet barcode on an envelope at the time of mailing so as to improve the routing and delivery time thereof. There are input keys or dials for a user to manually input digits comprising a ZIP+4 Code of an addressee. There is also calculator logic for calculating a tenth digit representing a check value associated with the digits of the ZIP+4 Code and a printer for printing a sequence of Postnet barcode characters corresponding to respective ones of the digits of the ZIP+4 Code and the tenth digit comprising the ten digit Postnet barcode. In a manuel version, the calculator logic is separate from manual input and printing apparatus. A user uses the calculator logic to calculate the tenth digit and then inputs it manually for printing. In a powered version, the calculator logic is included with the logic which drives a mechanical printhead such as an inkjet or dot matrix printer.

15 Claims, 5 Drawing Sheets

PERSONAL POSTNET BARCODE PRINTERS

BACKGROUND OF THE INVENTION

This invention relates to desktop and hand-held barcode printers and, more particularly, to a printer for printing a ten digit Postnet barcode on an envelope comprising, input means for a user to manually input digits comprising a ZIP Code of an addressee; calculator means for calculating a tenth digit representing a check value associated with the digits of the ZIP Code; and, printer means for printing a sequence of Postnet barcode characters corresponding to respective ones of the digits of the ZIP Code and the tenth digit preceded and followed by single long bars indicating the start and end of the ten digit Postnet barcode.

The movement of mail in a timely manner is one of the prime concerns of most businesses and many individuals. Over the years, as the amount of mail to be delivered has continued to increase year by year, users have found that the cost has risen and the service schedule has become worse and worse. Domestic mail delivery used to be like international mail delivery; that is, if "surface mail" was designated, the delivery was a long process and if "air mail" was designated, the delivery time was shortened considerably. For example, domestic surface delivery from one coast to the other typically took close to a week while air mail (for only a few cents more) could result in delivery in two days, and some times even one.

The domestic designation of "air mail" was abolished some time back. Since that time, the time for delivery has risen to the point where it sometimes takes almost as long as the old "surface mail". The primary cause of these delays appears to be in sorting the ever-increasing volume of mail to point it towards its ultimate destination. A number of years ago, the U.S. Postal Service introduced the so-called ZIP Code which is appended to an address following the State designation. The five digit ZIP Code provided a general routing for mail indicating the ultimate delivery location on a general city area basis. More recently, the U.S. Postal Service has introduced the so-called ZIP+4 Code which provides routing for a letter practically to the addressee's doorstep.

To use the ZIP+4 Code more effectively, the U.S. Postal Service has also begun using automated routing machinery which scans each letter for the ZIP+4 Code in a unique barcode format called Postnet. When a letter is received by the U.S. Postal Service at a receiving station, apparatus at the receiving station recognizes the presence of the ZIP+4 Code Postnet barcode on an incoming envelope and immediately routes it to be included with the barcoded mail. Unbarcoded mail is scanned by optical character recognition (OCR) devices to determine if the ZIP or ZIP+4 Code is contained thereon as part of the address. If it is, the automated machinery prints the Postnet barcode representation thereof adjacent the bottom righthand edge of the envelope within a "Postnet clear zone". Thereafter, the envelope is routed completely by automated machinery on the basis of the Postnet barcode. If the ZIP or ZIP+4 Code is not readable by the OCR equipment (as in the case of hand-written addresses, it must be reviewed by a human operator and the appropriate ZIP+4 Code manually input, if there. That, of course, greatly delays the initial processing of that particular piece of mail.

As can be appreciated, if mailed envelopes were to have their ZIP+4 Code Postnet barcode representations printed within the Postnet clear zone at the time of mailing, it would be of benefit to all concerned. Many companies have their return envelopes (for bill paying etc.) pre-printed with their own ZIP+4 Code Postnet barcode for that very reason. The result is a vast increase in the speed of delivery and much lower handling cost for the U.S. Postal Service. In fact, use of the ZIP+4 Code Postnet barcode on mailed articles can decrease delivery time by as much as one or two days and is such a savings to the U.S. Postal Service that they will provide a reduced postage rate for bulk users.

Thus, it can be seen that if most businesses and individuals pre-stamped their mail with the ZIP+4 Code Postnet barcode of the recipient, much use of high-cost overnight delivery services could be eliminated (with attendant savings to the sender) and projected increases in postal rates could be reduced or possibly be avoided altogether.

At present, there is no low-cost means for the average business and individual to add the ZIP+4 Code Postnet barcode to their mail. The lowest cost "desktop" models of Postnet barcode printer presently available appear to be in the $20,000.00 range. This is certainly outside of the range of the vast majority of potential users and beneficiaries of the practice.

Wherefore, it is an object of this invention to provide very low cost apparatus for allowing a user to add the ZIP+4 Code Postnet barcode of each addressee to their mail at the time of addressing the envelope prior to mailing.

It is another object of this invention to provide a hand-held envelope printer for allowing a user to add the ZIP+4 Code Postnet barcode of each addressee to their mail at the time of addressing the envelope prior to mailing.

It is yet another object of this invention to provide a manually operated desk-top envelope printer for allowing a user to add the ZIP+4 Code Postnet barcode of each addressee to their mail at the time of addressing the envelope prior to mailing.

It is still another object of this invention to provide a low-cost electronic/electrically operated desktop envelope printer for allowing a user to add the ZIP+4 Code Postnet barcode of each addressee to their mail at the time of addressing the envelope prior to mailing.

Other objects and benefits of this invention will become apparent from the detailed description which follows hereinafter when taken in conjunction with the drawing figures which accompany it.

SUMMARY

The foregoing objects have been achieved by the printer of the present invention for printing a ten digit Postnet barcode on an envelope comprising, input means for a user to manually input digits comprising a ZIP Code of an addressee; calculator means for calculating a tenth digit representing a check value associated with the digits of the ZIP Code; and, printer means for printing a sequence of Postnet barcode characters corresponding to respective ones of the digits of the ZIP Code and the tenth digit preceded and followed by single long bars indicating the start and end of the ten digit Postnet barcode.

One embodiment is a powered version which is primarily for desktop use and which additionally comprises alignment gauge means for receiving and positioning an envelope under the printer means so as to have the printer means print the ten digit Postnet barcode on the envelope in a pre-established position with respect to bottom and right hand edges thereof as required to be read by mail sorting apparatus of the U.S. Postal Service.

In that embodiment, the input means comprises a plurality of digit keys corresponding to digits from 0 to 9; the printer means includes a mechanical printer head for printing on a paper surface; and, the calculator means comprises digital logic means connected to the input means and the printer head for receiving inputs from the digit keys, for calculating the tenth digit, and for driving the printer head to print the ten digit Postnet barcode on the envelope. Additionally, there are display means for displaying a plurality of digits; a PRINT key; and, a CLEAR key; and wherein, the digital logic means is connected to the display means and the PRINT and CLEAR keys and includes logic means for displaying a sequence of digits entered by a user through the digit keys on the display means, for clearing the display means when the CLEAR key is pressed by a user; and for causing the digital logic means to calculate the tenth digit and drive the printer head to print the ten digit Postnet barcode on the envelope when the PRINT key is pressed by a user. Preferably, the digital logic means also includes logic means for checking the number of digits that have been entered by a user and for displaying an ERROR message on the display means if other than 9 digits have been entered.

In an alternate manual embodiment which can be configured for either hand-held or desktop use, the input means comprises a plurality of digit keys corresponding to digits from 0 to 9 and ten digit selectors each having indicia associated therewith corresponding to digits from 0 to 9; and, the printer means comprises ten barcode print members each having a plurality of raised print positions thereon comprising, respectively, Postnet barcode characters corresponding to digits from 0 to 9, the digit selectors being connected to respective ones of the barcode print members whereby a user can position selected barcode characters over a print line by selecting corresponding digits with the digit selectors; and additionally comprising, display means for displaying a single digit; and wherein, the calculator means comprises digital logic means connected to the digit keys and the display means for receiving inputs from the digit keys, for calculating the tenth digit, and for displaying the tenth digit on the display means whereby a user can manually input the tenth digit into a corresponding one of the digit selectors to complete a ten digit Postnet barcode sequence.

In this embodiment, there are also a pair of jaws mounted for opening and closing movement with respect to one another; activation means for moving the jaws between open and closed positions; the barcode print members are carried by one of the jaws; and, alignment gauge means are carried by the other of the jaws for receiving and positioning an envelope under the print line of the barcode print members so as to have the barcode print members print the ten digit Postnet barcode on the envelope in a pre-established position with respect to bottom and right hand edges thereof as required to be read by mail sorting apparatus of the U.S. Postal Service.

In one approach to inking in this embodiment, there is a cartridge having an inked ribbon carried by an arm extending outward therefrom and slot means are associated with the one of the jaws for receiving and holding the arm and for positioning the inked ribbon under the print line of the barcode print members whereby when an envelope is disposed in the alignment gauge means and the jaws are moved to the closed position, the raised print positions of the barcode print members disposed along the print line transfer ink from the inked ribbon to the envelope.

In another approach to inking in this embodiment, there is a stamp pad comprising a pad having a liquid ink impregnated therein carried by a positioning arm whereby a user can position the pad under the print line of the barcode print members and move the jaws to the closed position to transfer a coating of the ink to ones of the raised print positions of the barcode print members disposed along the print line for subsequent use in printing on an envelope.

DESCRIPTION OF THE PREFERRED EMBODIMENTS

Barcode printers (both hand-held and desktop versions) per se are known in the art. All other barcodes such as those employed to mark products sold at retail sales points and scanned by point of sale equipment, however, operate on a one-for-one basis; that is, if the product code comprises nine digits, the barcode is a nine digit barcode having a barcode representation for each of the nine digits. The ZIP+4 Code, however, differs from other barcodes in that it carries a tenth digit which acts like the parity bit in binary computer data. When the checker at a supermarket scans a box of corn flakes and there is an error in the barcode, the equipment will either not recognize the code and refuse to read it in or it will display the wrong article identification and price—which will be caught by the customer or the checker. In the case of the Postnet barcode, however, a misread barcode will result in the associated letter being sent in a completely erroneous direction. Thus, the tenth digit is carried as a check on the other nine. It is this tenth digit which makes the Postnet barcode and a printer therefor unique and not a trivial extrapolation from prior art bar code printers. In other words, the reason that there have been no inexpensive hand-held/desktop Postnet barcode printers to date is that they are not obvious variations from those barcode printers which are known in the art.

A barcode printer 10 according to the present invention in its simplest (i.e. hand-held) embodiment is shown in FIGS. 1–9. As shown in very simplified form in FIG. 9, the printer 10 comprises upper and lower jaws 12 and 14, respectively, hingedly joined at 16 which can be connected to a pair of handles 18, for example, so that when the handles 18 are squeezed, the jaws are brought together as indicated by the arrows 20 so as to grip and print on an envelope disposed therebetween. Such gripping and printing actions for a pair of hinged jaws are well known in the art and, per se, form no part of the novelty of this invention. For purposes of simplicity and the avoidance of redundancy, therefore, this aspect will not be shown or described in any greater detail.

Figure 2:
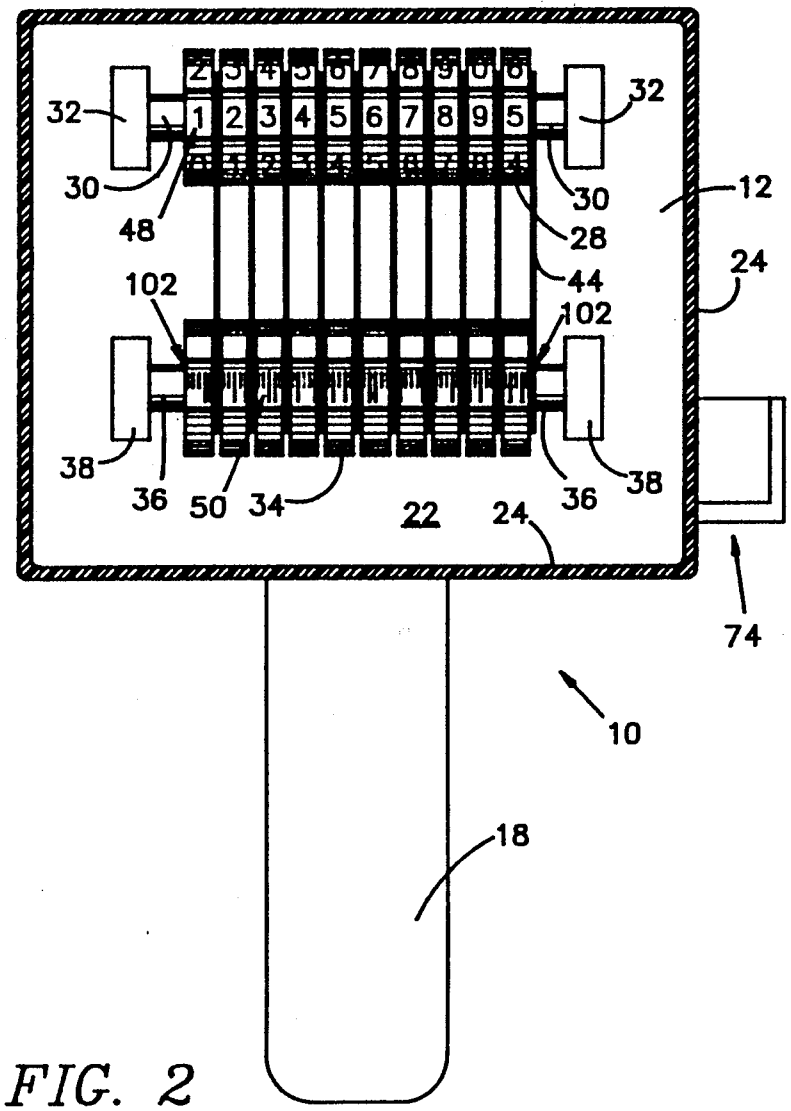
FIG. 2 is a simplified plan view of the inside of the printer of FIG. 1.
Figure 1:
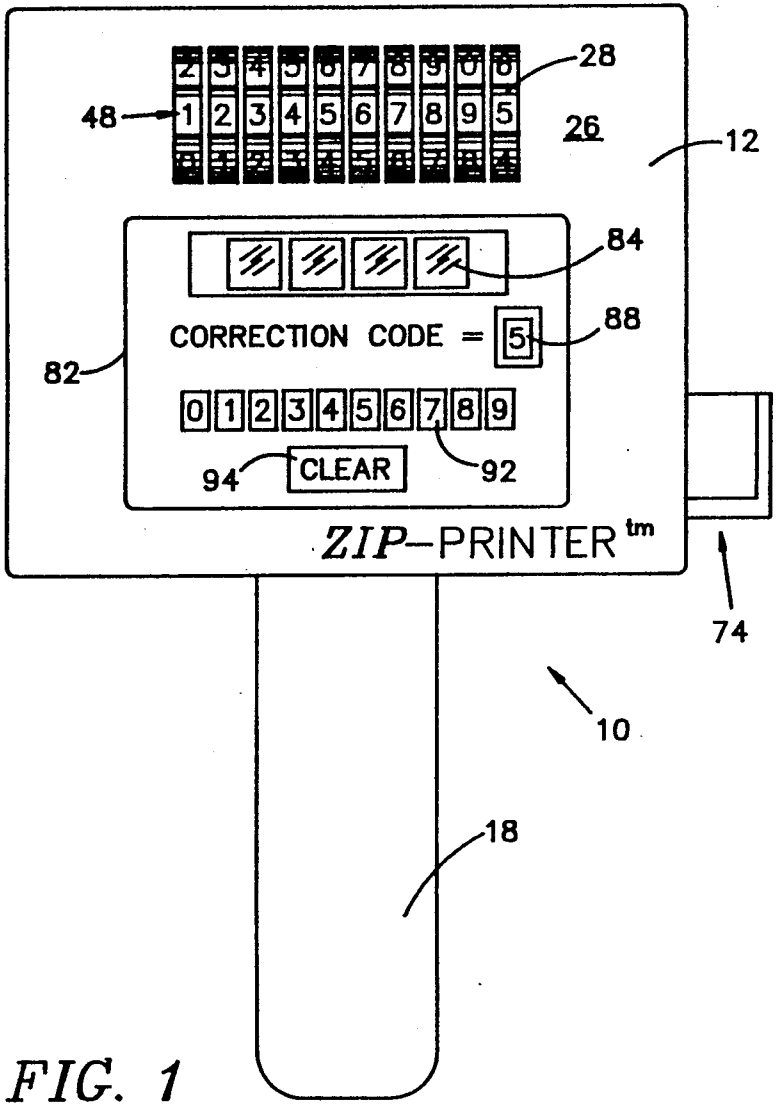
FIG. 1 is a simplified plan view of a hand-held printer according to the present invention for printing postnet barcodes on envelopes.
Figure 4:
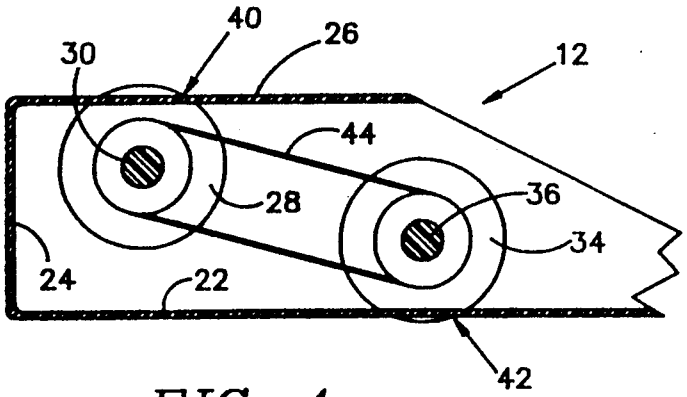
FIG. 4 is a simplified partial cutaway side view of the printer of FIGS. 1 and 2 showing the interconnection of the digit select wheels and the barcode printing wheels.
Figure 7:
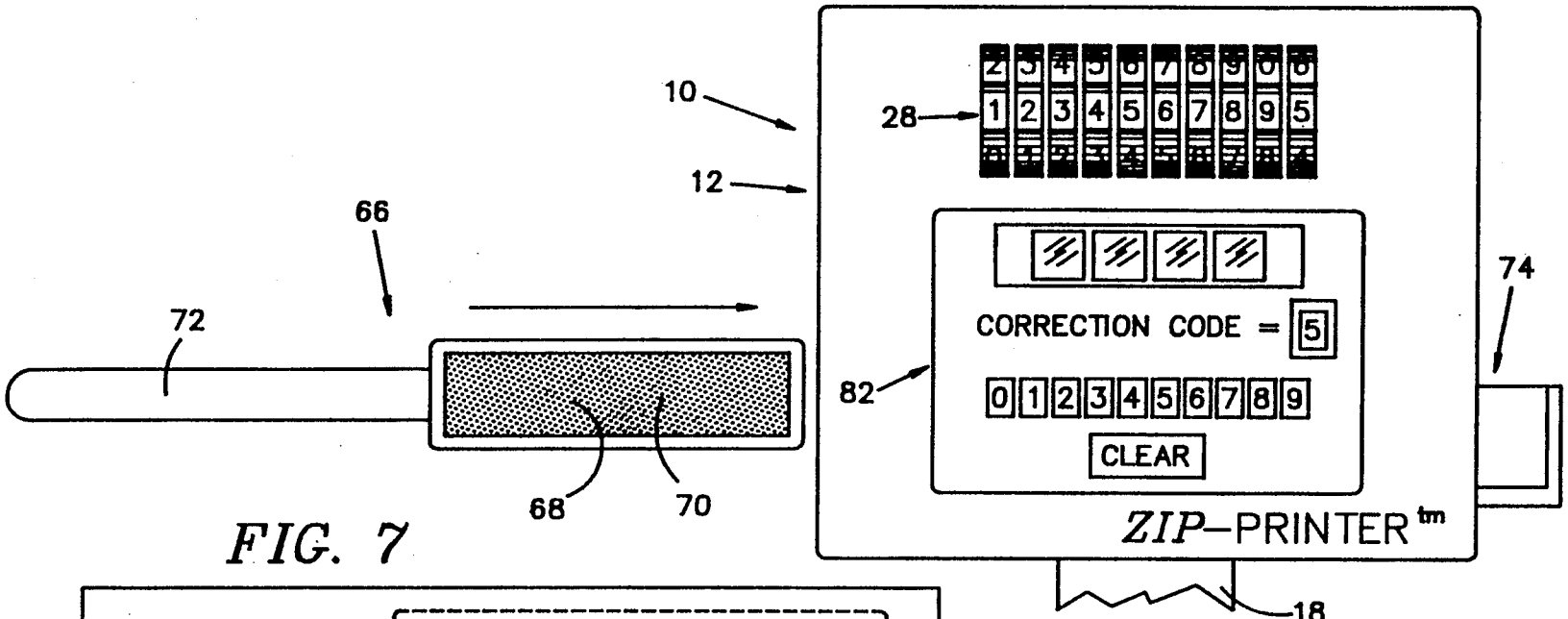
FIG. 7 is a simplified plan view of the printer of FIGS. 1 and 2 showing the use of a removeable stamp pad associated therewith.

Preferably, the bulk of the printer 10 and the components thereof are formed of one of the non-brittle plastics in general use today for such applications. Accordingly, the parts can be mass produced at low cost using injection molding techniques and then be assembled by snap fit and/or adhesive joining of the parts. The upper jaw 12 contains and carries the bulk of the operating portions of the printer 10. The upper jaw 12 is hollow having a bottom 22, sidewalls 24, and a top 26. There are ten digit select wheels 28 mounted for rotation on a shaft 30 supported on its ends by a pair of supports 32 formed into the bottom 22. There are ten barcode printing wheels 34 mounted for rotation on a shaft 36 supported on its ends by a pair of supports 38 also formed into the bottom 22. As best seen in FIG. 2, the ten digit select wheels 28 are mounted parallel to and in alignment with the ten barcode printing wheels 34. As best seen in FIG. 4, the ten digit select wheels 28 are mounted above the ten barcode printing wheels 34 such that the ten digit select wheels 28 extend above the top 26 through a rectangular slot 40 provided therein for the purpose while the ten barcode printing wheels 34 extend below the bottom 22 through a rectangular slot 42 provided therein for the purpose. The ten digit select wheels 28 are individually connected to respective ones of the ten barcode printing wheels 34 by a plurality of string belts 44 fit into traction grooves 46 formed into the digit select wheels 28 and barcode printing wheels 34 for the purpose. The string belts 44 each preferably comprises a loop of non-stretch stranded material such as a nylon. This approach allows the barcode printing wheels 34 in particular to be disposed close enough to one another on the shaft 36 so that there is no undesired space between the characters of the Postnet barcode printed thereby. Other methods of positioning barcode character printing elements in association with a numerical input could, of course, be employed within the scope and spirit of the present invention. For example, the numerical digits could be printed on one side of ten adjacent plastic strips with the associated Postnet barcode characters disposed in raised form on the underside. By sliding the strips, the digits and their associated barcode characters would then be selected and positioned for printing. The wheel-oriented approach as described above is, however, the preferred approach for various reasons.

Each of the digit select wheels 28 has indicia 48 of the digits 0–9 located at radially equal points about its outer periphery. Similarly, each of the barcode printing wheels 34 has the Postnet barcode characters corresponding to the digits 0–9 in the form of raised bars 50 located at radially equal points about its outer periphery. The digit select wheels 28 are initially positioned and interconnected 180° with respect to the barcode printing wheels 34 such that when a digit is being viewed through the slot 40 in the top 26, its corresponding Postnet barcode character is in position to print through the slot 42 in the bottom 22.

Figure 3:
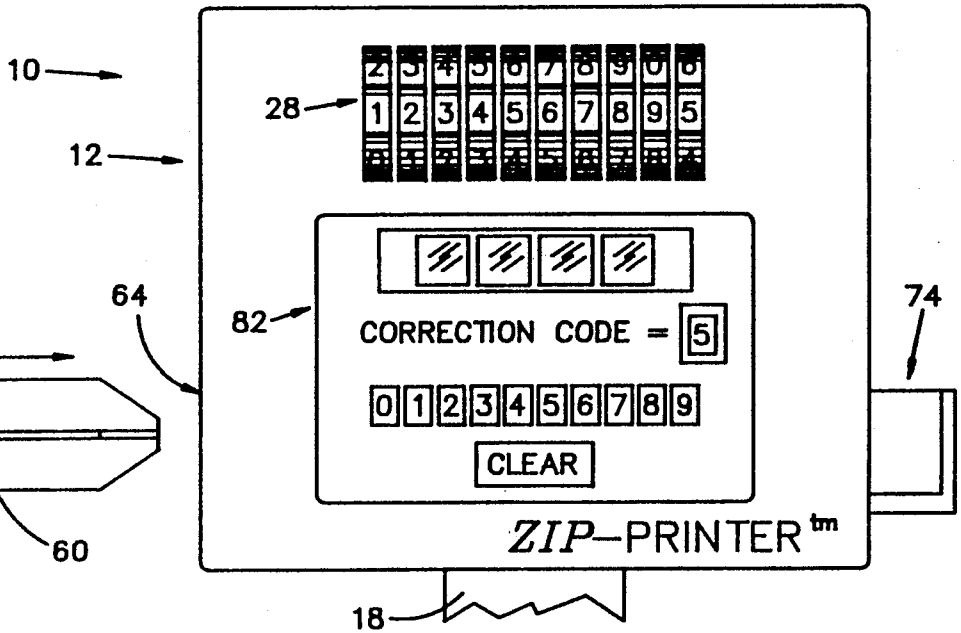
FIG. 3 is a simplified plan view of the printer of FIGS. 1 and 2 showing the use of a removeable ribbon cartridge associated therewith.
Figure 6:
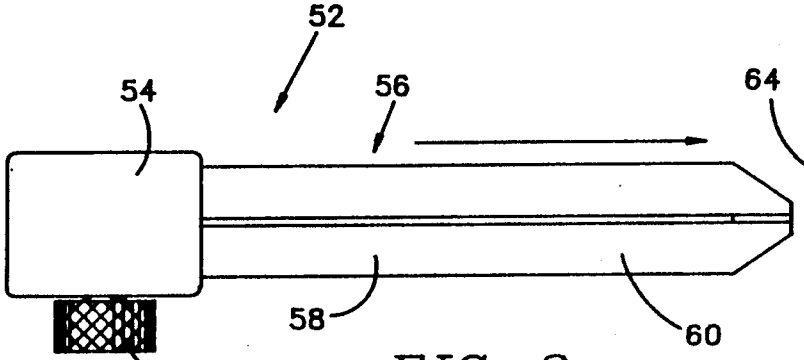
FIG. 6 is an enlarged simplified cutaway drawing through the traction groove in the top portion of one of the digit select wheels showing the gripping of the connecting belt drive thereby.
Figure 6:
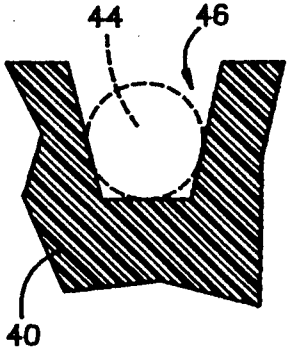
Figure 5:
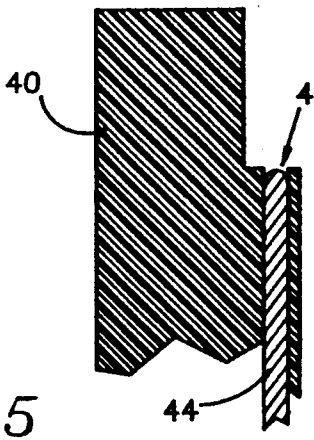
FIG. 5 is an enlarged simplified cutaway drawing through the top portion of one of the digit select wheels showing the attachment of the connecting belt drive thereto.

The "ink" necessary to print the Postnet barcode on an envelope can be provided in one of two ways. As depicted in FIG. 3, a removable cartridge 52 can be employed. The cartridge 52 comprises a body 54 having an arm 56 extending outward therefrom. A Mylar (or the like) strip 58 having a pressuretransferable ink 60 thereon (of the type employed with modern typewriters) passes from a supply reel (not shown) within the body 54 along the arm 56 and back again to a takeup reel (not show) also within the body 54. The strip 58 is advanced, as needed, by turning the knob 62 which is connected to the takeup reel. In use, the arm 56 is slid into a slot at 64 in the upper jaw 12 provided therefor which holds the arm 56 and positions the strip 58 under the slot 42 to be contacted by the barcode printing wheels 34 when the jaws 12, 14 are gripped together thereby transferring the ink 60 corresponding to the Postnet barcode being printed to an envelope.

Alternatively, a specially constructed stamp pad 66 can be employed to ink the barcode printing wheels 34 directly. The stamp pad 66 comprises a pad 68 sized to fit over the slot 42 and impregnated with a liquid ink 70. The pad 68 is mounted on the end of a positioning arm 72. In use, the pad 68 is positioned over the slot 42 and the jaws 12, 14 are gripped together to transfer ink 70 onto the barcode printing wheels 34. The stamp pad 66 is then removed, an envelope inserted, and the jaws 12, 14 gripped together once again to transfer ink 70 from the barcode printing wheels 34 onto the envelope.

Figure 8:
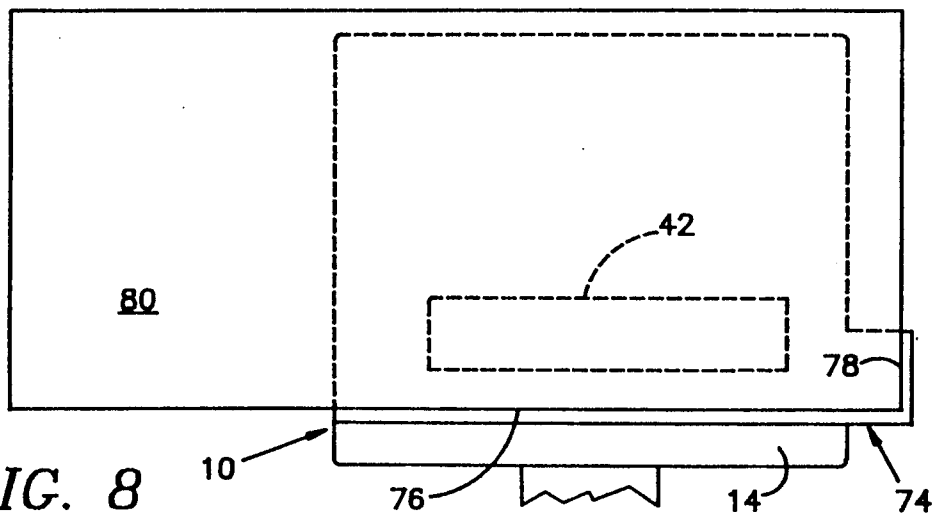
FIG. 8 is a simplified plan view of the bottom jaw of the printer of FIGS. 1 and 2 showing the envelope alignment gauge incorporated therein.
Figure 9:
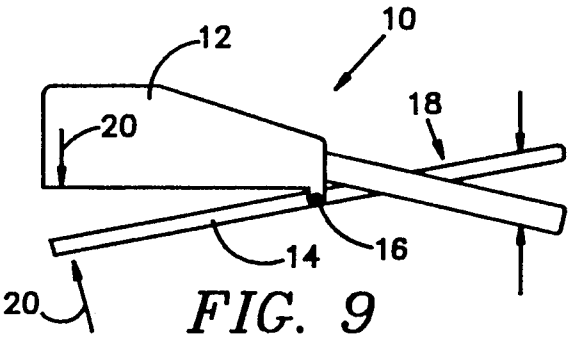
FIG. 9 is a simplified side view of the printer of FIGS. 1 and 2 showing the gripping action of the jaws thereof used for printing on an envelope.

As depicted in FIG. 8, an important aspect of the invention is the envelope alignment gauge 74 incorporated into the lower jaw 14. The gauge 74 comprises a bottom stop 76 and a right end stop 78. The stops 76 and 78 are positioned with respect to the slot 42 such that when an envelope 80 is inserted into the gauge 74, it is positioned with the slot 42 over the point within the Postnet clear zone of the envelope 80 where the Postnet barcode is to be printed according to the standards set by the U.S. Postal Service.

Figure 12:
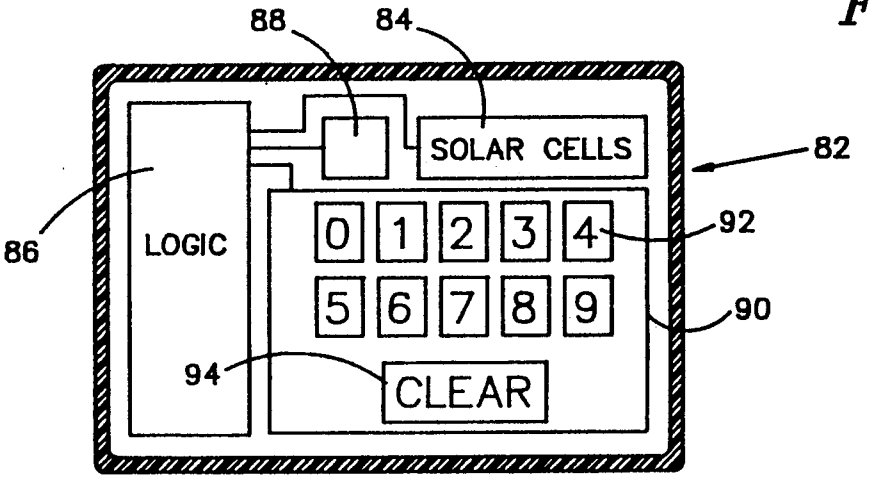
FIG. 12 is a functional block diagram of the inside of the tenth digit calculator of FIG. 1.
Figure 13:
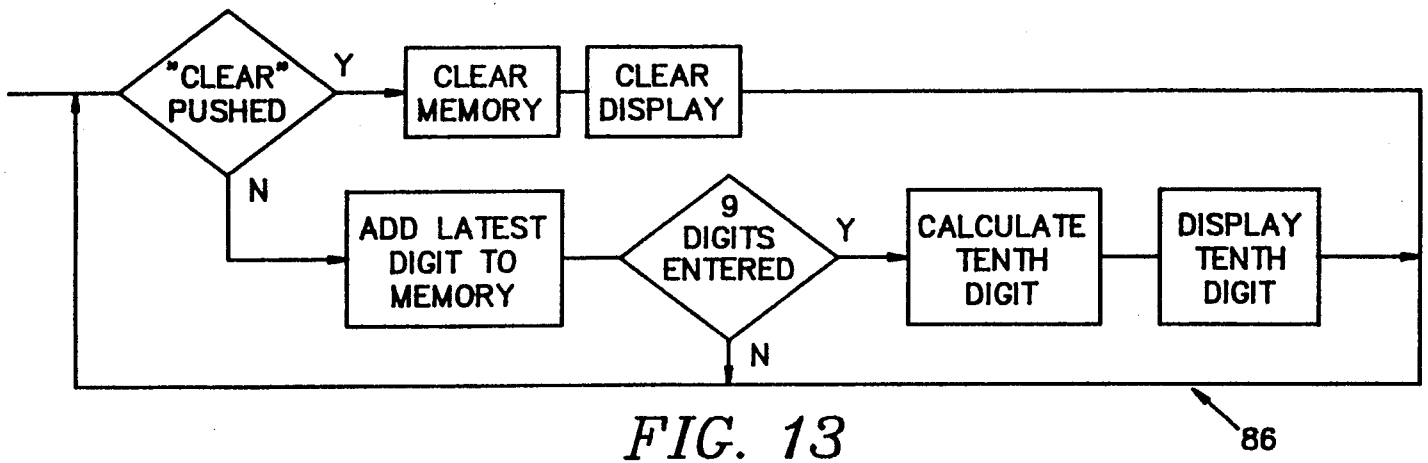
FIG. 13 is a logic flowchart of the logic contained in the tenth digit calculator associated with the printer of FIGS. 1 and 2.

The one remaining factor not yet accounted for is the tenth digit of the barcode. This is taken care of by the special purpose calculator 82 built into (or adhesively attached to) the top 26. The components of the calculator 82 in its preferred embodiment are shown in FIG. 12 and the logic thereof is depicted in FIG. 13. It is anticipated that the logic thereof to be described herein after will be implemented as digital logic on a single chip as is common in such applications according to the prior art. As is also common in such applications, it is anticipated that all the components to be described will be mounted to a common printed circuit board. Power is provided from room lighting by means of the solar cells 84 which are connected to the logic 86. A single digit liquid crystal display 88 is also connected to be driven by the logic 86. Finally, a keypad 90 having keys 92 for the digits 0–9 and a CLEAR key 94 is also connected as an input to the logic 86. In use and as depicted in the logic flowchart of FIG. 13, the user inputs the first nine digits (i.e. the ZIP+4 digits) into nine of the ten digit select wheels 28. The CLEAR key 94 is then pressed and those same first nine digits are entered into the keys 92. As soon as the logic 86 senses that the ninth digit has been entered, it calculates the tenth digit and displays it on the display 88. The user then manually inputs the tenth digit into the remaining digit select wheel 28 and prints the total Postnet barcode. The calculation of the tenth digit is according to techniques well known to those skilled in the art and easily ascertainable without undue experimentation from numerous publications available from the U.S. Postal Service such as "A Guide To Business Mail Preparation".

As those skilled in the art will readily recognize and appreciate, the hand-held printer 10 as described above can be easily adapted into a manually operated desktop printer by mounting the jaws 12, 14 on a base and having them moved in their gripping action by means of a lever instead of the handles 18.

Figure 11:
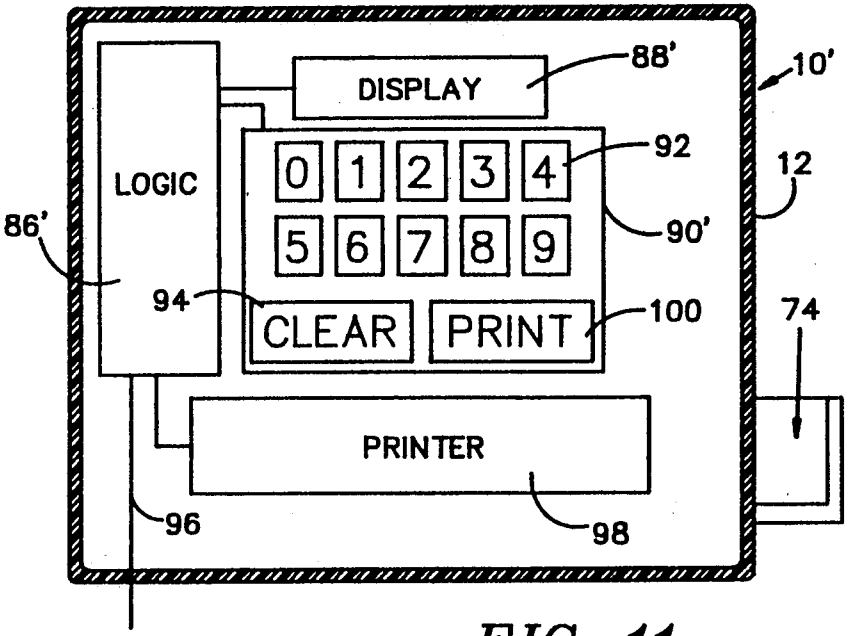
FIG. 11 is a simplified plan view and functional block diagram of the inside of the printer of FIG. 10.
Figure 10:
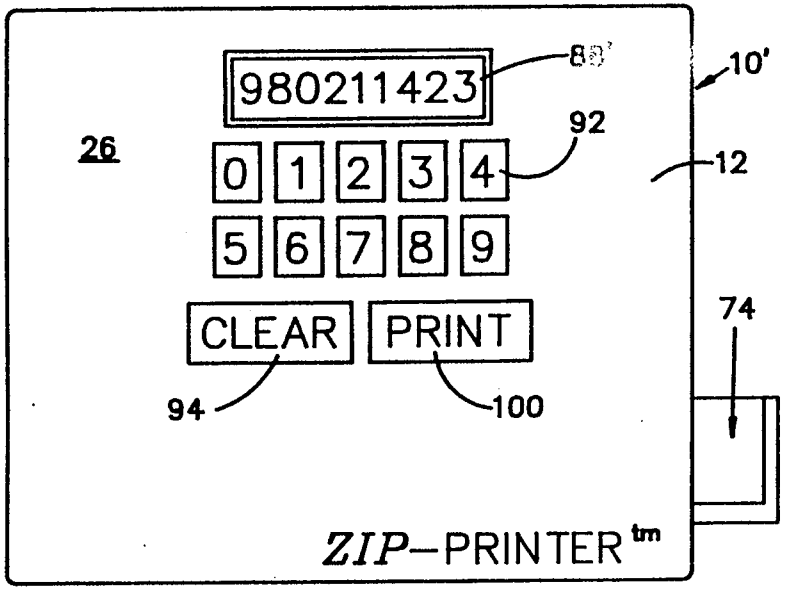
FIG. 10 is a simplified plan view of an electronic desktop printer according to the present invention for printing postnet barcodes on envelopes according to an alternate embodiment.
Figure 14:
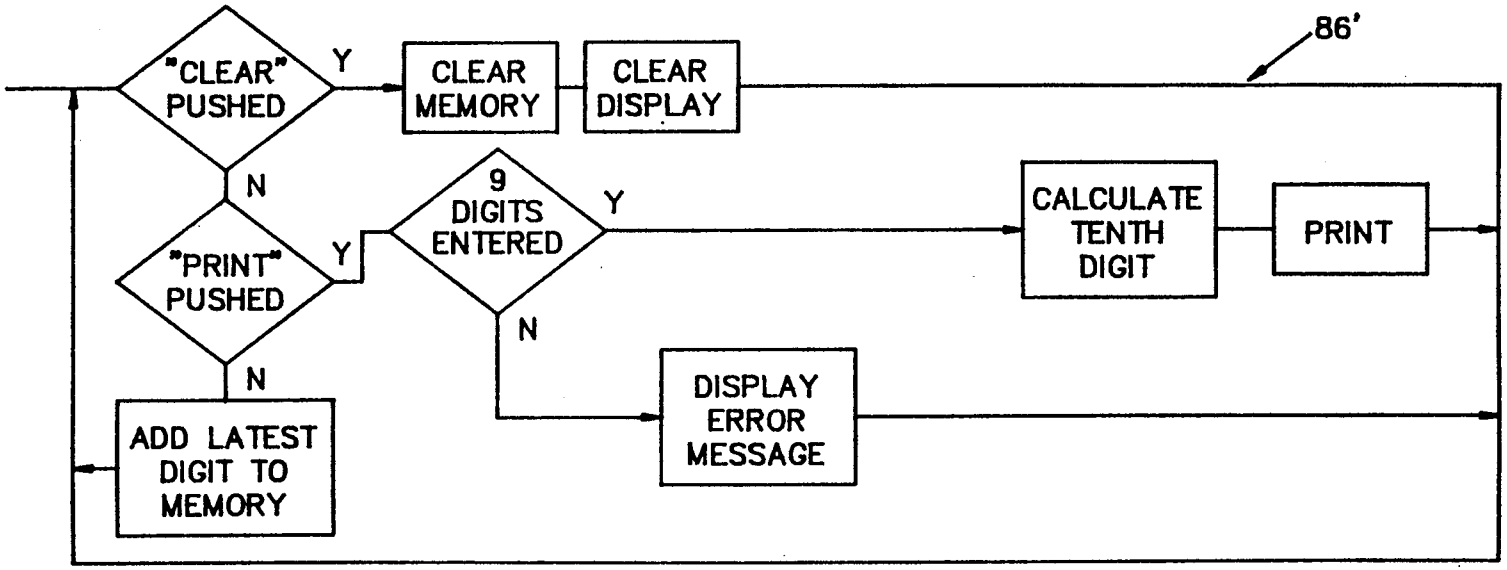
FIG. 14 is a logic flowchart of the logic contained in the printer of FIGS. 10 and 11.

A slightly more elaborate version of the present invention is shown in FIGS. 10 and 11 and the logic flowchart of FIG. 14 where it is generally indicated as 10'. The printer 10' is intended to be a desktop model and is electronically/electrically operated. As in the prior version, there is an upper jaw 12 containing the working components and a lower jaw 14 having an alignment gauge 74 for receiving, holding, and positioning an envelope placed between the jaws 12, 14. As with the calculator 82 of the prior embodiment, the printer 10' includes logic 86' which is powered by an appropriate source of power 96 of sufficient capacity to drive the printer 98 connected thereto which prints the actual Postnet barcode on an envelope. Preferably, the source of power 96 is one of the low voltage transformers presently used with most electronic equipment which plugs directly into the wall. Of course, batteries and/or rechargeable batteries could be employed, if desired, if more convenient and for portable operation. There is a keypad 90' including the digit keys 92 and the CLEAR key 94 as well as a PRINT key 100. The preferred printer 98 is an inkjet device such as those made and sold by Hewlett-Packard which is moved horizontally across the envelope to print thereon. The alignment gauge 74 could, of course, move an envelope horizontally across and in front of the printer 98 if preferred. Likewise, a dot matrix printhead could also be used as the printer 98, if preferred. In such case, a separate supply of ink would be required (the reason that the inkjet device is preferred). The cartridge 52 of FIG. 3 could be employed for this purpose.

In use (as depicted in the logic of FIG. 14), the user positions an envelope between the jaws 12, 14 in the alignment gauge 74, pushes the CLEAR key 94, and then inputs the digits of the ZIP+4 Code into the digit keys 92. As the digits are input, they are displayed on the LCD display 88'. After nine digits have been input, the user can then depress the PRINT key 100. If nine digits have not been input when the PRINT key 100 is pressed, an ERROR message is displayed. Otherwise, the tenth digit is calculated as in the previous embodiment, inserted into the digit string, and the entire ten digit Postnet barcode is printed on the envelope by the printer 98. For repeat printing of envelopes with the same ZIP+4 Code, the PRINT key 100 is simply pressed again after another envelope is inserted.

As those skilled in the art and familiar with the Postnet barcode convention will readily appreciate, the Postnet barcode is comprised of a series of equally spaced bars of equal thickness wherein some of the bars are long bars and some of the bars are short bars and whichever embodiment of the present invention is implemented, the printing portion thereof must start and end the barcode sequenc with a long bar. With the automated version of the present invention, the start- and stop-indicating long bars are printed by the logic 86' and printer 98. In the manual versions, they are printed by fixed long bar printers located at 102 disposed adjacent the ends of the barcode printing wheels 34 as indicated in FIG. 2.

Also, while the term "envelope" is employed herein by way of example as the most common use for the present invention, the printer of the present invention can also be employed to put the Postnet barcode sequence of an addressee's ZIP+4 Code on labels, and the like. Despite the use of the term envelope in the appended claims, therefore, the term is not to be construed as limiting and other forms of addressed medium are to be included within the interpretation of that term for purposes of establishing the breadth of the claims within the scope and spirit of the invention as disclosed herein.

Thus, it can be seen that the present invention has met its stated objectives by providing several embodiments of a low-cost printer which allows virtually anyone to have the capability to pre-stamp outgoing mail with its Postnet barcode representation of the associated ZIP+4 Code thereby assuring the most rapid delivery of the mail possible.

Wherefore, having thus described our invention, what is claimed is:

1. A self-contained and stand-alone printer for printing a ten digit Postnet barcode on an envelope comprising:

(a) a hollow case;

(b) input means carried by said case for a user to manually input digits comprising a ZIP+4 Code of an addressee;

(c) calculator means carried by said case for calculating a tenth digit representing a check value associated with said digits of said ZIP+4 Code; and, (d) printer means carried by said case for printing a sequence of Postnet barcode characters corresponding to respective ones of said digits of said ZIP+4 Code and said tenth digit preceded and followed by single long bars indicating a start and end of the ten digit Postnet barcode.

2. The printer of claim 1 wherein:
(a) said input means comprises a plurality of digit keys corresponding to digits from 0 to 9;
(b) said printer means includes a mechanical printer head for printing on a paper surface; and,
(c) said calculator means comprises digital logic means connected to said input means and said printer head for receiving inputs from said digit keys, for calculating said tenth digit, and for driving said printer head to print the ten digit Postnet barcode on said envelope.

3. The printer of claim 2 and additionally comprising:
(a) display means for displaying a plurality of digits;
(b) a PRINT key; and,
(c) a CLEAR key; and wherein,
(d) said digital logic means is connected to said display means and said PRINT and CLEAR keys and includes logic means for displaying a sequence of digits entered by a user through said digit keys on said display means, for clearing said display means when said CLEAR key is pressed by a user; and for causing said digital logic means to calculate said tenth digit and drive said printer head to print the ten digit Postnet barcode on said envelope when said PRINT key is pressed by a user.

4. The printer of claim 3 wherein:
said digital logic means also includes logic means for checking the number of digits that have been entered by a user, for displaying an ERROR message on said display means if other than 9 digits have been entered.

5. The printer of claim 1 wherein:
(a) said input means comprises a plurality of digit keys corresponding to digits from 0 to 9 and ten digit selectors each having indicia associated therewith corresponding to digits from 0 to 9; and,
(b) said printer means comprises ten barcode print members each having a plurality of raised print positions thereon comprising, respectively, Postnet barcode characters corresponding to digits from 0 to 9, said digit selectors being connected to respective ones of said barcode print members whereby a user can position selected barcode characters over a print line by selecting corresponding digits with said digit selectors; and additionally comprising,
(c) display means for displaying a single digit; and wherein,
(d) said calculator means comprises digital logic means connected to said digit keys and said display means for receiving inputs from said digit keys, for calculating said tenth digit, and for displaying said tenth digit on said display means whereby a user can manually input said tenth digit into a corresponding one of said digit selectors to complete a ten digit Postnet barcode sequence.

6. The printer of claim 5 and additionally comprising:
(a) a pair of jaws mounted for opening and closing movement with respect to one another;
(b) activation means for moving said jaws between open and closed positions;
(c) said barcode print members being carried by one of said jaws; and,
(d) alignment gauge means carried by the other of said jaws for receiving and positioning an envelope under said print line of said barcode print members so as to have said barcode print members print the ten digit Postnet barcode on said envelope in a pre-established position with respect to bottom and right hand edges thereof as required to be read by mail sorting apparatus of the U.S. Postal Service.

7. The printer of claim 6 and additionally comprising:
(a) a cartridge having an inked ribbon carried by an arm extending outward therefrom; and,
(b) slot means associated with said one of said jaws for receiving and holding said arm and for positioning said inked ribbon under said print line of said barcode print members whereby when an envelope is disposed in said alignment gauge means and said jaws are moved to said closed position, said raised print positions of said barcode print members disposed along said print line transfer ink from said inked ribbon to said envelope.

8. The printer of claim 6 and additionally comprising:
a stamp pad comprising a pad having a liquid ink impregnated therein carried by a positioning arm whereby a user can position said pad under said print line of said barcode print members and move said jaws to said closed position to transfer a coating of said ink to ones of said raised print positions of said barcode print members disposed along said print line for subsequent use in printing on an envelope.

9. A self-contained, automated, and stand-alone printer for printing a ten digit Postnet barcode on an envelope comprising:
(a) a hollow case;
(b) input means carried by said case for a user to manually input digits comprising a ZIP+4 Code of an addressee, said input means comprising a plurality of digit keys corresponding to digits from 0 to 9;
(c) printer means including a mechanical printer head carried by said case for printing on a paper surface for printing a sequence of Postnet barcode characters corresponding to respective ones of said digits of said ZIP+4 Code and said tenth digit preceded and followed by single long bars indicating the start and end of the ten digit Postnet barcode;
(d) alignment gauge means carried by said case for receiving and positioning an envelope under said printer means so as to have said printer means print the ten digit Postnet barcode on said envelope in a pre-established position with respect to bottom and right hand edges thereof as required to be read by mail sorting apparatus of the U.S. Postal Service; and,
(e) calculator means carried by said case for calculating a tenth digit representing a check value associated with said digits of said ZIP+4 Code, said calculator means comprising digital logic means connected to said input means and said printer head for receiving inputs from said digit keys, for calculating said tenth digit, and for driving said printer head to print the ten digit Postnet barcode on said envelope.

10. The printer of claim 9 and additionally comprising:
(a) display means for displaying a plurality of digits;
(b) a PRINT key; and,
(c) a CLEAR key; and wherein,
(d) said digital logic means is connected to said display means and said PRINT and CLEAR keys and includes logic means for displaying a sequence of digits entered by a user through said digit keys on said display means, for clearing said display means when said CLEAR key is pressed by a user; and for causing said digital logic means to calculate said tenth digit and drive said printer head to print the ten digit Postnet barcode on said envelope when said PRINT key is pressed by a user.

11. The printer of claim 10 wherein:

said digital logic means also includes logic means for checking the number of digits that have been entered by a user, for displaying an ERROR message on said display means if other than 5 or 9 digits have been entered, and for adding four 0s if 5 digits have been entered.

12. A self-contained, hand-operated, and stand-alone printer for printing a ten digit Postnet barcode on an envelope comprising:

(a) a hollow case;

(b) input means carried by said case for a user to manually input digits comprising a ZIP+4 Code of an addressee, said input means comprising a plurality of digit keys corresponding to digits from 0 to 9 and ten digit selectors each having indicia associated therewith corresponding to digits from 0 to 9;

(c) hand-operated printer means carried by said case for printing a sequence of Postnet barcode characters corresponding to respective ones of said digits of said ZIP+4 Code and said tenth digit preceded and followed by single long bars indicating the start and end of the ten digit Postnet barcode, said printer means comprising ten barcode print members each having a plurality of raised print positions thereon comprising, respectively, Postnet barcode characters corresponding to digits from 0 to 9 said digit selectors being connected to respective ones of said barcode print members whereby a user can position selected barcode characters over a print line by selecting corresponding digits with said digit selectors;

(d) display means carried by said case for displaying a single digit; and, (e) calculator means carried by said case for calculating a tenth digit representing a check value associated with said digits of said ZIP+4 Code, said calculator means comprising digital logic means connected to said digit keys and said display means for receiving inputs from said digit keys, for calculating said tenth digit, and for displaying said tenth digit on said display means whereby a user can manually input said tenth digit into a corresponding one of said digit selectors to complete a ten digit Postnet barcode sequence.

13. The printer of claim 12 and additionally comprising:

(a) a pair of jaws mounted for opening and closing movement with respect to one another;

(b) activation means for moving said jaws between open and closed positions;

(c) said barcode print members being carried by one of said jaws; and, (d) alignment gauge means carried by the other of said jaws for receiving and positioning an envelope under said print line of said barcode print members so as to have said barcode print members print the ten digit Postnet barcode on said envelope in a pre-established position with respect to bottom and right hand edges thereof as required to be read by mail sorting apparatus of the U.S. Postal Service.

14. The printer of claim 13 and additionally comprising:

(a) a cartridge having an inked ribbon carried by an arm extending outward therefrom; and, (b) slot means associated with said one of said jaws for receiving and holding said arm and for positioning said inked ribbon under said print line of said barcode print members whereby when an envelope is disposed in said alignment gauge means and said jaws are moved to said closed position, said raised print positions of said barcode print members disposed along said print line transfer ink from said inked ribbon to said envelope.

15. The printer of claim 13 and additionally comprising:

a stamp pad comprising a pad having a liquid ink impregnated therein carried by a positioning arm whereby a user can position said pad under said print line of said barcode print members and move said jaws to said closed position to transfer a coating of said ink to ones of said raised print positions of said barcode print members disposed along said print line for subsequent use in printing on an envelope.

* * * * *